US008387574B2

(12) United States Patent
McCloy et al.

(10) Patent No.: US 8,387,574 B2
(45) Date of Patent: Mar. 5, 2013

(54) VENTING MECHANISM TO ENHANCE WARMING OF A VARIABLE CAM TIMING MECHANISM

(75) Inventors: Chad McCloy, Cortland, NY (US); Franklin R. Smith, Cortland, NY (US); Timothy K. White, Sterling Heights, MI (US)

(73) Assignee: BorgWarner Inc., Auburn Hills, MI (US)

( * ) Notice: Subject to any disclaimer, the term of this patent is extended or adjusted under 35 U.S.C. 154(b) by 353 days.

(21) Appl. No.: 12/755,595

(22) Filed: Apr. 7, 2010

(65) Prior Publication Data

US 2010/0251981 A1 Oct. 7, 2010

Related U.S. Application Data

(60) Provisional application No. 61/167,407, filed on Apr. 7, 2009.

(51) Int. Cl.
*F01L 9/02* (2006.01)
*F01L 1/34* (2006.01)
*F01L 1/00* (2006.01)

(52) U.S. Cl. ..... 123/90.15; 123/90.17; 123/90.19; 123/90.12

(58) Field of Classification Search ..... 123/90.15, 123/90.17; 60/329
See application file for complete search history.

(56) References Cited

U.S. PATENT DOCUMENTS

| | | | | |
|---|---|---|---|---|
| 5,564,274 | A * | 10/1996 | Denbraber et al. | 60/329 |
| 6,883,475 | B2 * | 4/2005 | Simpson | 123/90.15 |
| 6,941,913 | B2 * | 9/2005 | Smith | 123/90.17 |
| 7,124,722 | B2 * | 10/2006 | Smith | 123/90.17 |
| 7,568,458 | B2 * | 8/2009 | Roth et al. | 123/90.17 |
| 8,220,427 | B2 * | 7/2012 | Child | 123/90.15 |
| 2002/0100445 | A1 * | 8/2002 | Takenaka et al. | 123/90.17 |

FOREIGN PATENT DOCUMENTS

WO WO 2006095531 A1 * 9/2006

* cited by examiner

*Primary Examiner* — Thomas Denion
*Assistant Examiner* — Steven D Shipe
(74) *Attorney, Agent, or Firm* — Brown & Michaels, PC

(57) ABSTRACT

The present invention increases cold temperature oil flow through the variable cam timing (VCT) phaser to reduce the amount of time it takes to replace this oil with warmer low viscosity oil and thereby improve performance. Furthermore the oil flow through the VCT phaser is reduced once the oil temperature reaches the minimum operating temperature for the VCT phaser to operate and the VCT phaser is commanded to move from the park position. Therefore, the VCT phaser is charged with hot engine oil and is commanded to move from the parked position. The VCT phaser reduces oil flow through the phaser at high oil temperatures and low oil viscosity while adding the benefit of increased oil flow through the phaser at low oil temperatures and high oil viscosity to facilitate getting warmer oil into the VCT phaser sooner for increased VCT performance.

19 Claims, 10 Drawing Sheets

VENT HOLES CLOSED

VENT HOLES OPEN

VENT GROOVES CLOSED

VENT GROOVES OPEN

VENTING MECHANISM TO ENHANCE WARMING OF A VARIABLE CAM TIMING MECHANISM

REFERENCE TO RELATED APPLICATIONS

This application claims one or more inventions which were disclosed in Provisional Application No. 61/167,407, filed Apr. 7, 2009, entitled "VENTING MECHANISM TO ENHANCE WARMING OF A VARIABLE CAM TIMING MECHANISM". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable cam timing systems. More particularly, the invention pertains venting of the variable cam timing phaser or mechanism to enhance warming of a variable cam timing phaser.

2. Description of Related Art

During engine startup, when an engine is cold and the oil viscosity is high there is a delay in getting warm engine oil to flow through the variable cam timing (VCT) mechanism, and therefore delays occur in obtaining the increased performance of the VCT mechanism when hot oil is available. Since the VCT mechanism is a hydraulic mechanism that uses engine oil as its working fluid, the performance of the VCT mechanism is reduced at a higher oil viscosity. Therefore, it is desirable to introduce warm oil to the VCT mechanism as soon as possible to increase the VCT mechanism's performance.

Most prior art VCT mechanisms are designed to limit oil consumption when the engine oil is hot and at low viscosities. This same design limitation also limits the exchange of oil in the phaser at low oil temperatures and higher viscosities. The low exchange rate of oil in a typical VCT therefore limits the rate at which warmer oil is introduced to the VCT during the engine warm up cycle.

This design delays getting warm engine oil to flow through the VCT mechanism and therefore delays the increased performance the VCT mechanism experiences using hot oil. The VCT mechanism's performance can affect cold start emission and cold engine drivability so it is desirable to introduce warm oil into the VCT mechanism as soon as possible.

SUMMARY OF THE INVENTION

The present invention increases cold temperature oil flow through the variable cam timing (VCT) phaser to reduce the amount of time it takes to replace this oil with warmer low viscosity oil and thereby improve performance. Furthermore the oil flow through the VCT phaser is reduced once the oil temperature reaches the minimum operating temperature for the VCT phaser to operate and the VCT phaser is commanded to move from the park position. Therefore, the VCT phaser is charged with hot engine oil and is commanded to move from the parked position. The VCT phaser reduces oil flow through the phaser at high oil temperatures and low oil viscosity while adding the benefit of increased oil flow through the phaser at low oil temperatures and high oil viscosity to facilitate getting warmer oil into the VCT phaser sooner for increased VCT performance.

DETAILED DESCRIPTION OF THE INVENTION

Figure 2:
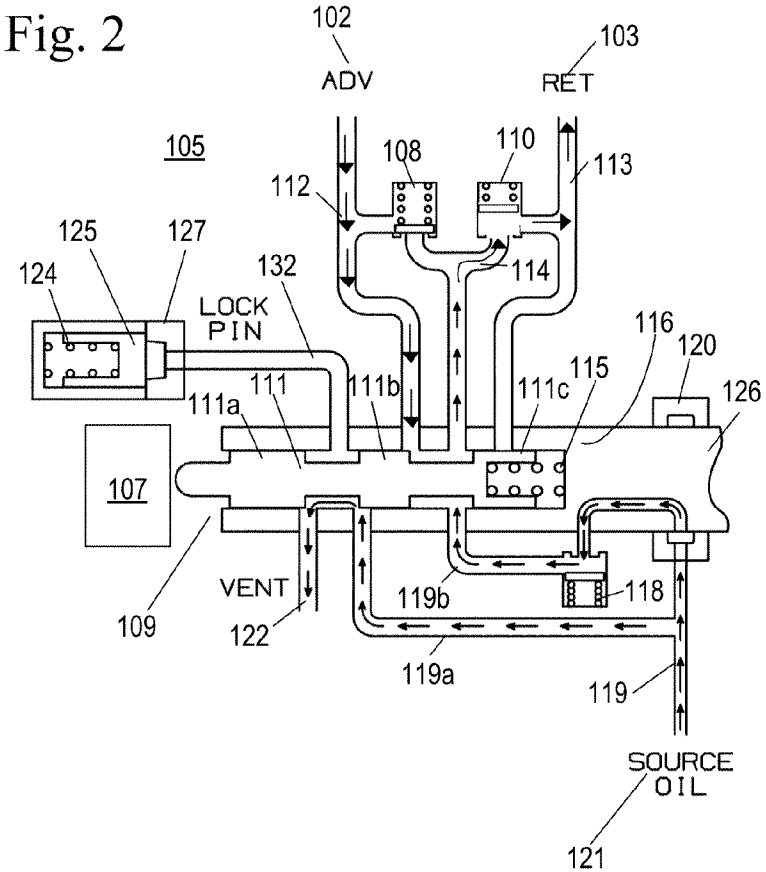
FIG. 2 shows a schematic of a variable cam timing phaser of a first embodiment moving towards a retard position in which passage to a vent is open and a lock pin is in a locked position.

FIGS. 1 through 14 show the operating modes of a variable cam timing (VCT) mechanism or phaser depending on spool valve position. The positions shown in the figures define a direction the VCT phaser is moving to. It is understood that the phase control valve 109, 159 has an infinite number of intermediate positions and is not limited to the positions shown in the Figures.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor assembly 105 with one or more vanes 104, mounted to the end of the camshaft 126, surrounded by a housing assembly 100 with the vane chambers into which the vanes fit. It is possible to have the vanes 104 mounted to the housing assembly 100, and the chambers in the rotor assembly 105, as well. The housing assembly 100 of the VCT phaser is attached to a first outer end plate 175 on a first side and a second inner end plate 176 on an opposite side. The first outer end plate 175 and the second inner end plate 176 close off the chambers formed between the housing assembly 100 and the rotor assembly 105 that receive the vanes of the rotor assembly 105 and define the advance chambers 102 and the retard chambers 103. The second inner end plate 176 has a circumference 101 that forms the sprocket, pulley or gear accepting drive force through a chain, belt, or gears, usually from the crankshaft, or possible from another camshaft in a multiple-cam engine.

Alternatively, the housing assembly 100 may have a circumference 101 that forms the sprocket, pulley or gear accepting drive force through a chain, belt, or gears, usually from the crankshaft, or possible from another camshaft in a multiple-cam engine.

Figure 1:
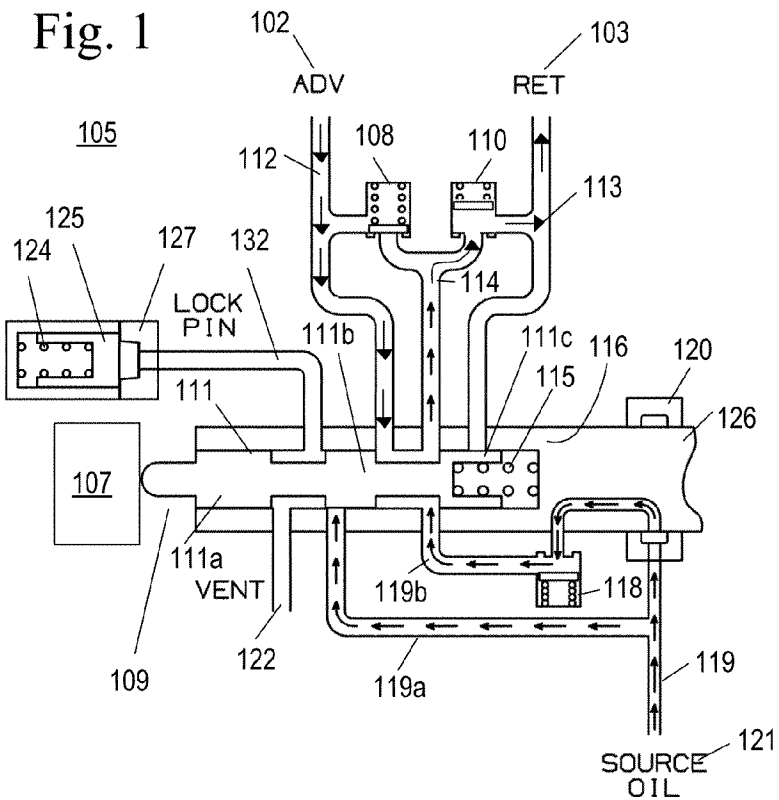
FIG. 1 shows a schematic of variable cam timing phaser of a first embodiment moving towards a retard position in which passage to a vent is closed and a lock pin is in a locked position.
Figure 3:
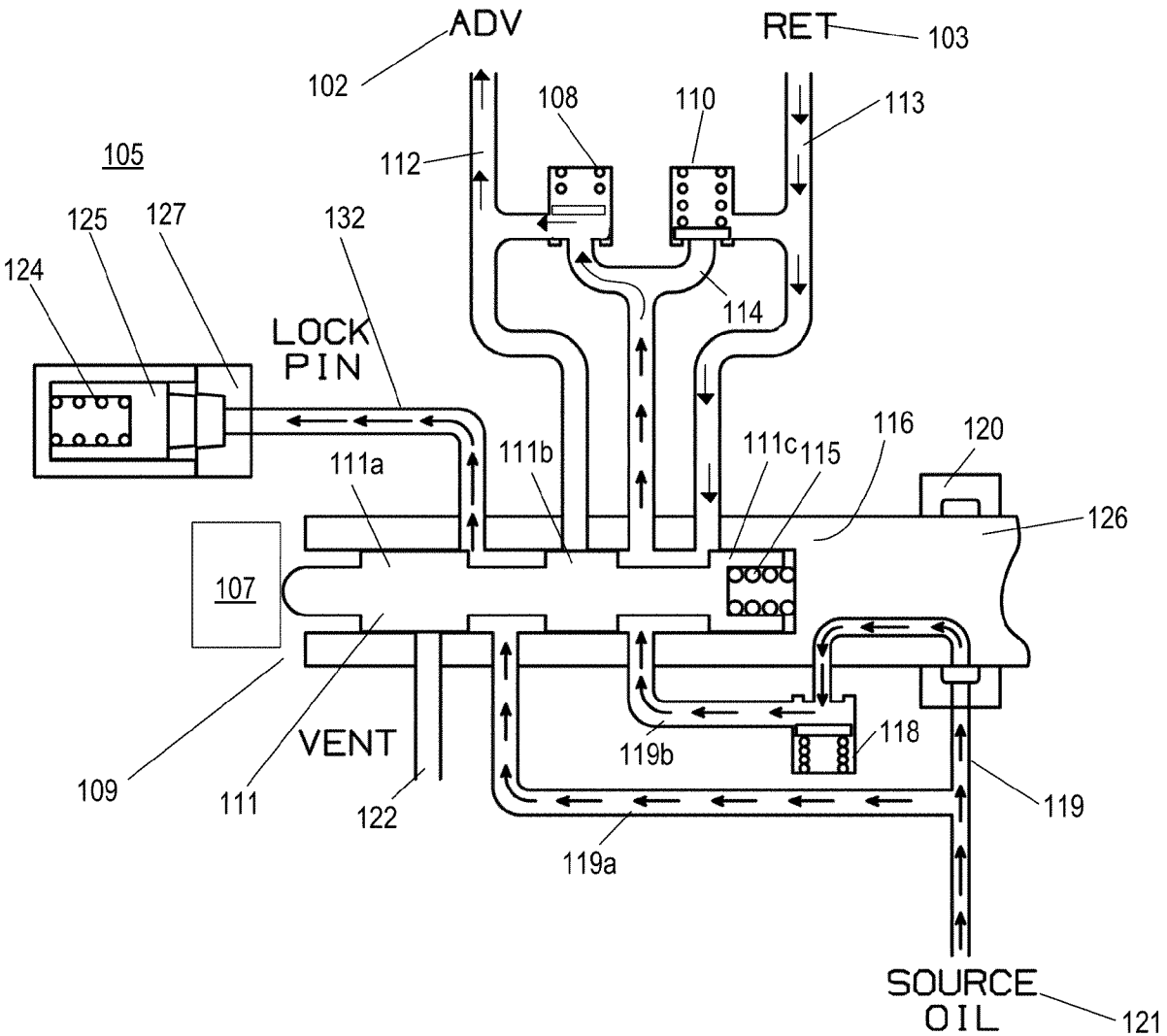
FIG. 3 shows a schematic of a variable cam timing phaser of a first embodiment moving towards an advance position in which passage to a vent is closed and a lock pin is unlocked.

Referring to FIGS. 1-3 of the first embodiment, torque reversals in the camshaft 126 caused by the forces of opening and closing engine valves move the vane 104. The advance and retard chambers 102, 103 are arranged to resist positive and negative torque pulses in the camshaft 126 and are alternatively pressurized by the cam torque. The control valve 109 allows the vane 104 in the phaser to move by permitting fluid flow from the advance chamber 102 to the retard chamber 103 or vice versa, depending on the desired direction of movement.

The rotor assembly 105 is connected to the camshaft 126 and is coaxially located within the housing assembly 100. The rotor assembly 105 has at least one vane 104 separating a chamber formed between the housing assembly 100 and the rotor assembly 105 into an advance chamber 102 and a retard chamber 103. The vanes 104 are capable of rotation to shift the relative angular position of the housing assembly 100 and the rotor assembly 105.

A lock pin 125 is slidably housed in a bore in the rotor assembly 105 and has an end portion that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The pressurization of line 132 leading to the lock pin 125 is controlled by the switching/movement of the phase control valve 109.

A control valve 109, preferably a spool valve, includes a spool 111 with cylindrical lands 111*a*, 111*b*, and 111*c* slidably received in a sleeve 116 within a bore in the rotor assembly 105 and pilots in the camshaft 126. One end of the spool contacts spring 115 and the opposite end of the spool contacts a control means 107. The control means may be a pulse width modulated variable force solenoid (VFS) 107, a motor, other actuators, or a solenoid that is linearly controlled by varying current or voltage or other methods as applicable.

The position of the spool 111 is influenced by spring 115 and the control means 107 controlled by an ECU (not shown). Further detail regarding control of the phaser is discussed in detail below. The position of the spool 111 controls the motion (e.g. to move towards the advance position, holding position, or the retard position) of the phaser, whether the lock pin 125 is locked or unlocked, and whether fluid source oil may flow continuously through the variable cam timing phaser to vent or sump 122 to bring warm oil from the engine sump to the VCT phaser sooner during the engine warm-up cycle.

Normally, to minimize oil consumption, the locking pin passage 132 would only communicate to the source oil pressure 121 to release the locking pin 125 from recess 127 or it would only communicate to the venting passage 122 to engage the locking pin 125 but not both source oil 121 and venting to vent passage 122 at the same time.

In the first embodiment the spool valve 109 is such that the fluid from lock pin passage 132 is open to vent to vent passage 122 and source oil 121 is also connected to the venting passage 122, such that there is simultaneously continuous oil flowing out of the vent passage 122 from the lock pin 125 and source oil 121. This increased oil flow would bring warm oil from the engine sump to the VCT phaser sooner during the engine warm up cycle. Once the VCT phaser is warm and commanded to move the vent passage 122 would be blocked or substantially reduced. By including a venting position within a VCT phaser, increased flow of cold oil for reduced time to introduce warm oil to the VCT phaser and reducing oil flow once the VCT phaser is operational with hot oil may be achieved.

It should be noted that the phase control valve 109 is an active control system for allowing for continuous venting from source oil 121 to sump 122 when the spool 111 is in a base timing position or default position in which the spool 111 is biased out from the sleeve 116 completely by the spring 115 only without any influence from the actuator 107. The base timing position or parking position is also the position of the spool 111 in which engine warm-up occurs.

In the advance mode, as shown in FIG. 3, the spool 111 is moved to a position so that fluid may flow from the retard chamber 103 through the spool 111 to the advance chamber 102, and fluid is blocked from exiting the advance chamber 102. Fluid from source 121 unlocks the lock pin 125 by pressurizing line 132, and venting of fluid from source 121 through spool 111 is prevented.

In a retard mode as shown in FIG. 1, the spool 111 is moved to a position so that fluid may flow from the advance chamber 102 through the spool 111 to the retard chamber 103, fluid is blocked from exiting the retard chamber 103. The lock pin 125 is locked and venting of fluid from source 121 through the spool 111 is prevented.

In venting mode as shown in FIG. 2, the spool 111 is moved to a position so that fluid may flow from the advance chamber 102 through the spool 111 to the retard chamber 103, fluid is blocked from exiting the retard chamber 103, a lock pin 125 is locked, and a small amount of fluid from source 121 may flow through a line 119*a* and the spool 111 to sump or vent 122.

Figure 4:
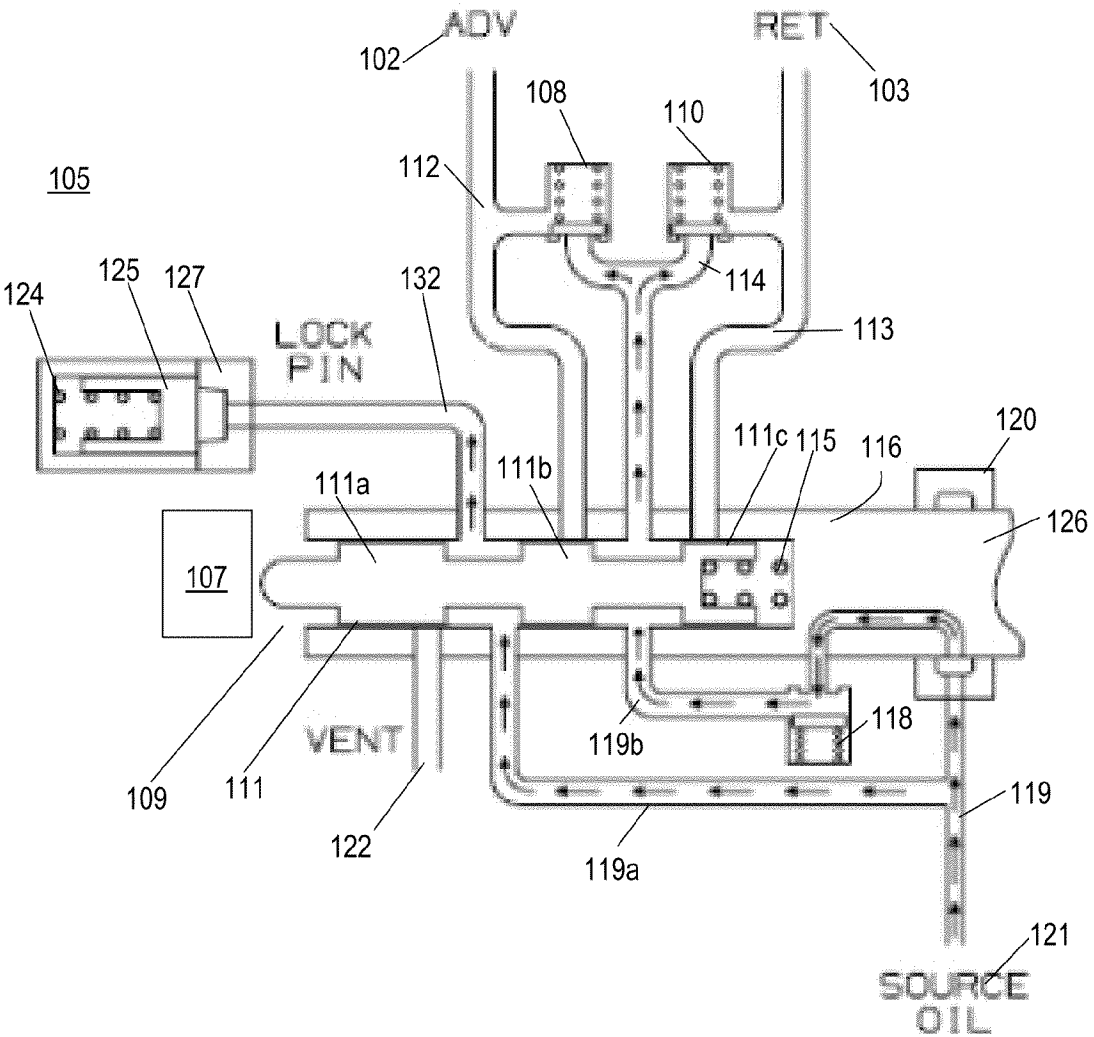
FIG. 4 shows a schematic of a variable cam timing phaser of a first embodiment in a null position in which passage to a vent is closed and a lock pin is unlocked.

In null mode as shown in FIG. 4, the spool 111 is moved to a position that blocks the exit of fluid from the advance and retard chambers 102, 103, and venting of fluid from source 121 to vent 122 is not permitted. Makeup oil may be supplied to the advance and retard chambers 102, 103 as needed. Fluid from source 121 unlocks the lock pin 125 by pressurizing line 132.

FIG. 1 shows the phaser moving towards the retard position. To move towards the retard position, the force of the control means 107 on the spool 111 is changed, such that the spool 111 is moved to the left in a retard mode in the figure by spring 115, until the force of spring 115 balances the force of the control means 107. In the retard mode shown, spool land 111*c* blocks line 113 and lines 112 and 114 are open. Camshaft torque pressurizes the advance chamber 102, causing fluid in the advance chamber 102 to move into the retard chamber 103, and the vane 104 to move accordingly. Fluid exits from the advance chamber 102 through line 112 to the control valve 109 between spool lands 111*b* and 111*c* and recirculates back to central or common line 114 and line 113 leading to the retard chamber 103.

Makeup oil is supplied to the phaser from supply S 121 to make up for leakage and enters line 119 through a bearing 120. Line 119 splits into two lines 119*a* and 119*b*. Line 119*b* leads to an inlet check valve 118 and the control valve 109.

From the control valve 109, fluid enters line 114 and then passes through either of the check valves 108, 110, depending on which is open to the chambers 102, 103. Line 119*a* leads to control valve 109 and is blocked by land 111*b* from pressurizing line 132 and from biasing the lock pin 125 to an unlocked position, and therefore, the lock pin 125 remains in a locked position, engaged with recess 127. Exhaust line 122 is open to line 132, so while any fluid that may have been present in this line vents, there is no constant amount of fluid that vents when the spool is in this position and would not contribute to warming up of the phaser.

FIG. 2 shows the phaser moving towards a venting position. To move towards a venting position, the force of the control means 107 on the spool 111 is changed and the spool 111 is moved to a venting mode in the figure, until the force of spring 115 balances the force of the control means 107. In a venting mode shown, spool land 111*c* blocks line 113 and lines 112 and 114 are open. Camshaft torque pressurizes the advance chamber 102, causing fluid in the advance chamber 102 to move into the retard chamber 103, and the vane 104 to move accordingly. Fluid exits from the advance chamber 102 through line 112 to the control valve 109 between spool lands 111*b* and 111*c* and recirculates back to central line 114 and line 113 leading to the retard chamber 103.

Makeup oil is supplied to the phaser from supply S 121 to make up for leakage and enters line 119 through a bearing 120. Line 119 splits into two lines 119*a* and 119*b*. Line 119*b* leads to an inlet check valve 118 and the control valve 109. From the control valve 109, fluid enters line 114 and then passes through either of the check valves 108, 110, depending on which is open to the chambers 102, 103. Line 119*a* leads to control valve 109 and is open such that fluid may continuously flow from supply or source oil 121 to vent passage 122 through the spool 111 between lands 111*a* and 111*b*. The pressure of the fluid that flows between line 119*a* and vent passage 122 is not great enough to pressurize line 132 and bias the lock pin 125 away from recess 127, and therefore, the lock pin 125 remains in a locked position, engaged with recess 127. Exhaust line 122 is open to line 132, so while any fluid that may have been present in this line vents, there is no constant amount of fluid from line 132 and would not contribute to warming up of the phaser.

FIG. 3 shows the phaser moving towards the advance position. To move towards the advance position, the force of the control means 107 on the spool 111 is increased and the spool 111 is moved to the right by the control means 107 in an advance mode, until the force of the spring 115 balances the force of the control means 107. In the advance mode shown, spool land 111*b* blocks line 112 and lines 113 and 114 are open. Camshaft torque pressurizes the retard chamber 103, causing fluid to move from the retard chamber 103 and into the advance chamber 102, and the vane 104 moves accordingly. Fluid exits from the retard chamber 103 through line 113 to the control valve 109 between spool lands 111*b* and 111*c* and recirculates back to central line 114 and line 112 leading to the advance chamber 102.

Makeup oil is supplied to the phaser from supply S 121 to make up for leakage and enters line 119 through a bearing 120. Line 119 splits into two lines 119*a* and 119*b*. Line 119*b* leads to an inlet check valve 118 and the control valve 109. From the control valve 109, fluid enters line 114 and then passes through either of the check valves 108, 110, depending on which is open to the chambers 102, 103. Line 119*a* leads to control valve 109 and is open to line 132 leading to the lock pin 125 The pressure of the fluid in line 119*a* moves through the spool 111 between lands 111*a* and 111*b* to pressurize line 132 and bias the lock pin 125 against the spring 124 to a released position. Exhaust line 122 is blocked by spool land 111*a*, preventing the lock pin 125 from venting.

When the phaser in the holding position as shown in FIG. 4, the force of the control means 107 on one end of the spool 111 equals the force of the spring 115 on the opposite end of the spool 111 in holding mode. The lands 111*b* and 111*c* block the flow of fluid to lines 112 and 113 respectively. Makeup oil is supplied to the phaser from supply S 121 by to make up for leakage and enters line 119 through a bearing 120. Line 119 splits into two lines 119*a* and 119*b*. Line 119*b* leads to inlet check valve 118 and the control valve 109. From the control valve 109, fluid enters line 114 and then passes through either of the check valves 108, 110, depending on which is open to the chambers 102, 103. Fluid from source 121 unlocks the lock pin 125 by pressurizing line 132.

The lock pin 125 may be used without using a control means 107 (i.e. use it as a passive system) by increasing venting that occurs at the default spool valve position or at a base timing of the phaser that occurs in the VCT phaser when the control system is turned off. Base timing or default position of the spool is when the spool 111 is biased out from the sleeve 116 completely by the spring 115 only without any influence from the actuator 107. The base timing position or parking position is also the position of the spool 111 in which engine warm-up occurs.

Preferably, and as shown in FIG. 2 the lock pin 125 may be used with a control means 107 to manage the venting process and the spool valve porting is designed such that a low amount of duty cycle or no duty cycle applied to the control valve 109 of the VCT phaser would move the spool 111 to a position of continuous venting of the source oil 121 out the vent passage 122 until the VCT phaser is commanded to move and the venting is substantially reduced.

FIGS. 5 through 10 show schematics of cross-sections of a variable cam timing phaser of second and third embodiments. The variable cam timing phaser in FIGS. 5-10 each have a rotor assembly 105 is connected to the camshaft and is coaxially located within the housing assembly 100. The rotor assembly 105 has at least one vane 104 separating a chamber formed between the housing assembly 100 and the rotor assembly 105 into an advance chamber 102 and a retard chamber 103. The vanes 104 are capable of rotation to shift the relative angular position of the housing assembly 100 and the rotor assembly 105. It is possible to have the vanes 104 mounted to the housing assembly 100, and the chambers in the rotor assembly 105, as well. The housing assembly 100 of the VCT phaser of the second and third embodiments is attached to a first outer end plate 175 on a first side and a second inner end plate 176 on an opposite side. The first outer end plate 175 and the second inner end plate 176 close off the chambers formed between the housing assembly 100 and the rotor assembly 105 that receive the vanes of the rotor assembly 105 and define the advance chambers 102 and the retard chambers 103. The second inner end plate 176 has a circumference 101 that forms the sprocket, pulley or gear accepting drive force through a chain, belt, or gears, usually from the crankshaft, or possible from another camshaft in a multiple-cam engine.

Torque reversals in the camshaft caused by the forces of opening and closing engine valves move the vane 104. The advance and retard chambers 102, 103 are arranged to resist positive and negative torque pulses in the camshaft 126 and are alternatively pressurized by the cam torque. A control valve, not shown in FIGS. 5-10, but similar to control valve 109 discussed above, allows the vane 104 in the phaser to move by permitting fluid flow from the advance chamber 102 to the retard chamber 103 or vice versa, depending on the desired direction of movement.

In the second and third embodiments, a controlled leak path or venting mechanism is created in the chambers 103 by including vent holes 145 or vent grooves 146 on the first outer end plate 175, in the second inner end plate 176, or both the first outer end plate 175 and the second inner end plate 176 to allow source oil 121 to flow into a common passage, such as passage 114 shown in FIGS. 1-3 to the chambers 103, such that a controlled leak path out of one or more of the VCT chambers 103 is present. The vent grooves 146 are preferably net-formed or worm trails, eliminating the need to drill holes in the second inner end plate 176. Additionally, the vent grooves 146 are preferably placed so that they are open or unblocked by the vane 104 when the VCT phaser is at a base timing and are closed off or blocked by the vane 104 of the rotor assembly 105 as it rotates away from base timing.

Preferably, more than one of the chambers 102, 103 has a leak path present. Furthermore, the leak path is shown to be in the retard chambers 103, however, the leak path may also be present in the advance chambers 102 of the variable cam timing phaser.

The vent groove 146 or vent holes 145 may also be equipped with a pressure relief valve, a one way check valve, or a temperature compensating valve. Source oil is typically higher at cold temperatures. A pressure relief valve may be used that would allow the higher oil pressure to leak at cold temperatures and would stay shut (supply oil pressure below valve pop off pressure) once the supply oil pressure reduced at warmer temperatures. If there is sufficient variation in source oil pressure, the amount of oil leaking from the phaser is limited once the oil is warm. If there is not enough variation in the oil pressure between hot and cold a spring loaded check valve would prevent oil from leaking out of the chambers 102, 103 when the engine is off. It will also prevent air from entering the chambers.

A temperature compensating valve may also be used to allow oil to vent at cold temperature and prohibit the flow of oil through the vent(s) after the oil warms up. This would allow for the exchange of cold oil after soaking the VCT phaser at cold temperature, but would eliminate oil loss at warm temperature.

Any of the above described embodiments may also include a flow path for the warmer source oil that increases the surface area exposed as the oil is flowing through the phaser. An example of this would be to require the oil to flow through a groove on the face of the rotor or cam end while it is being vented. This would increase the surface area and increase the volume of warm oil in the VCT phaser, increasing the warming rate of the oil in the phaser.

Figure 6:
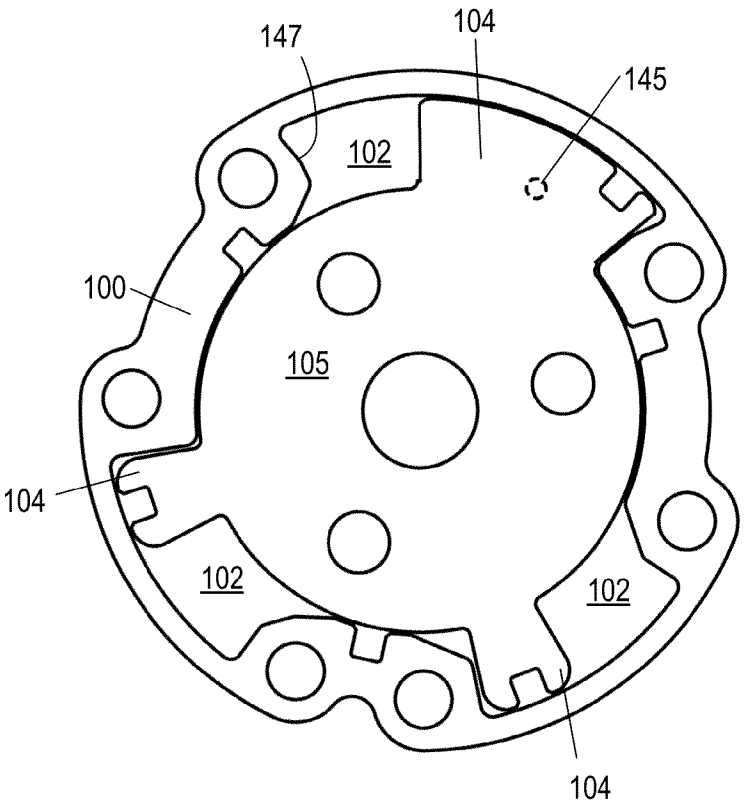
FIG. 6 shows a schematic of a cross-section of a variable cam timing phaser of a second embodiment in which vent holes on an outer plate are blocked.
Figure 5:
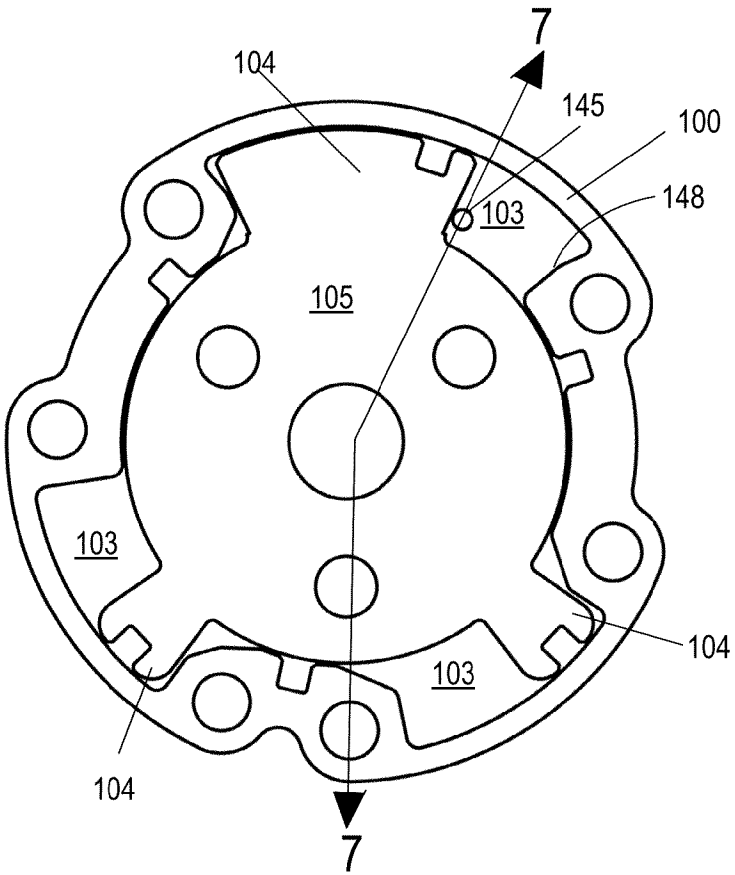
FIG. 5 shows a schematic of a cross-section of a variable cam timing phaser of a second embodiment in which vent holes on an outer plate are unblocked.
Figure 7:
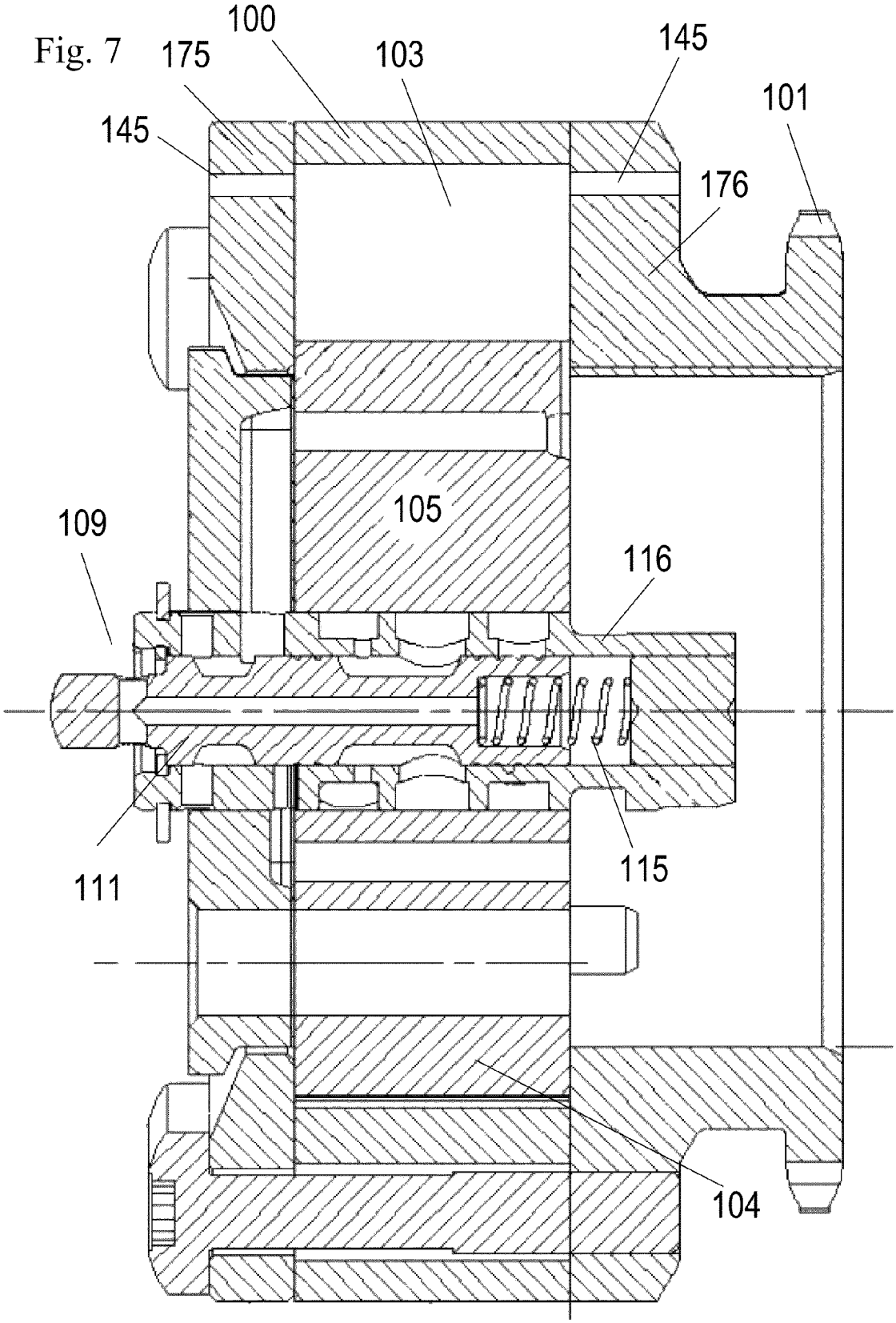
FIG. 7 shows a cross-section along line 7-7 of FIG. 5.

Referring to FIGS. 5-7, vent holes 145 are present on a first outer end plate 175 and the second inner end plate 176 of the phaser. When the phaser is in a retard position as shown in FIG. 5, and the vane 104 is adjacent an advance wall 147 in the chamber defined between the rotor assembly 105 and the housing assembly 100, the vent hole 145 is exposed to fluid in the retard chamber 103. When the phaser is in an advanced position as shown in FIG. 6, and the vane 104 is adjacent the retard wall 148, the vent hole 145 is blocked by the vane 104, preventing any controlled leakage of fluid from the retard chamber 103.

Figure 9:
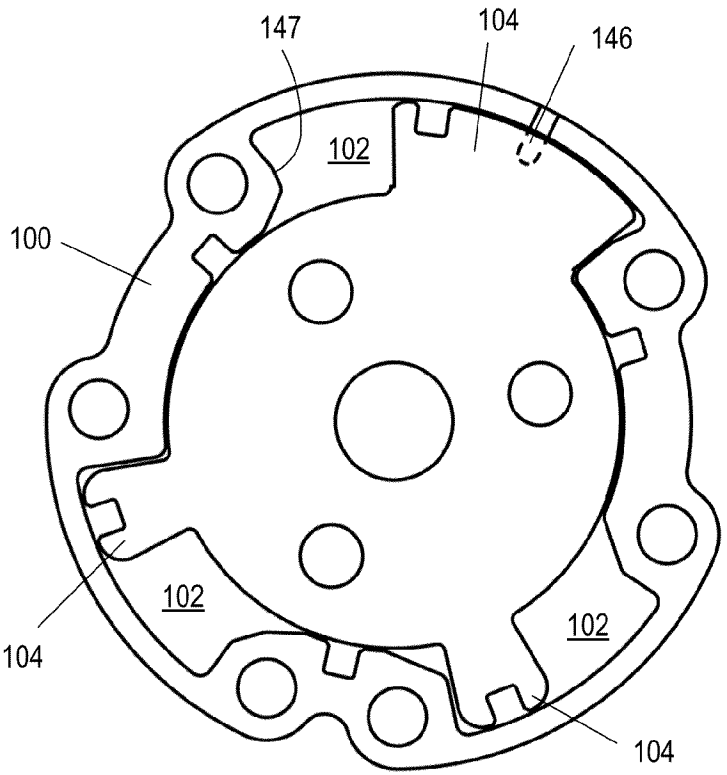
FIG. 9 shows a schematic of a cross-section of a variable cam timing phaser of a third embodiment in which slots in an inner plate are blocked.
Figure 8:
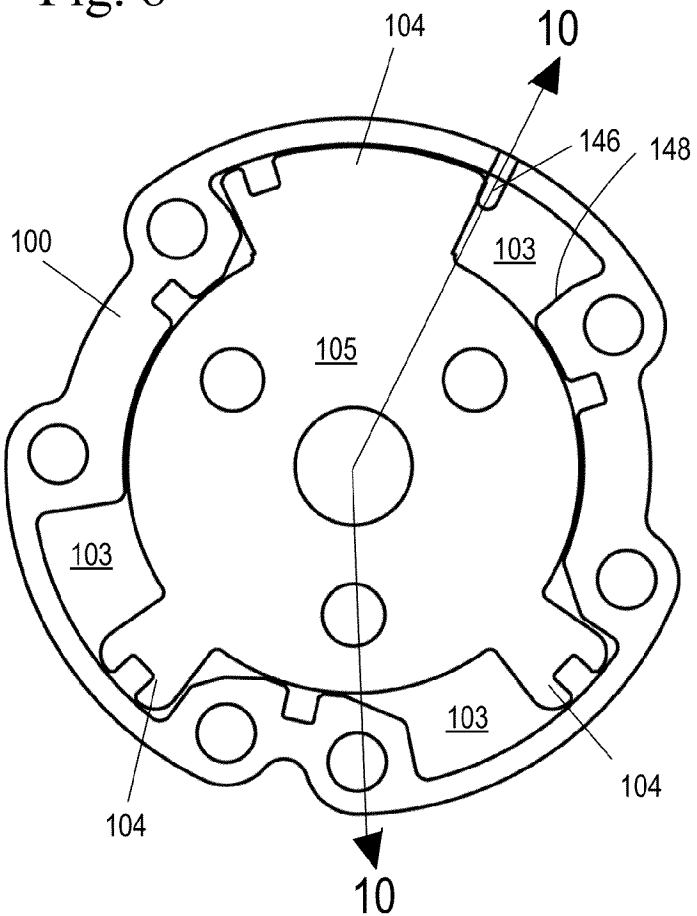
FIG. 8 shows a schematic of a cross-section of a variable cam timing phaser of a third embodiment in which slots on an inner plate are unblocked.
Figure 10:
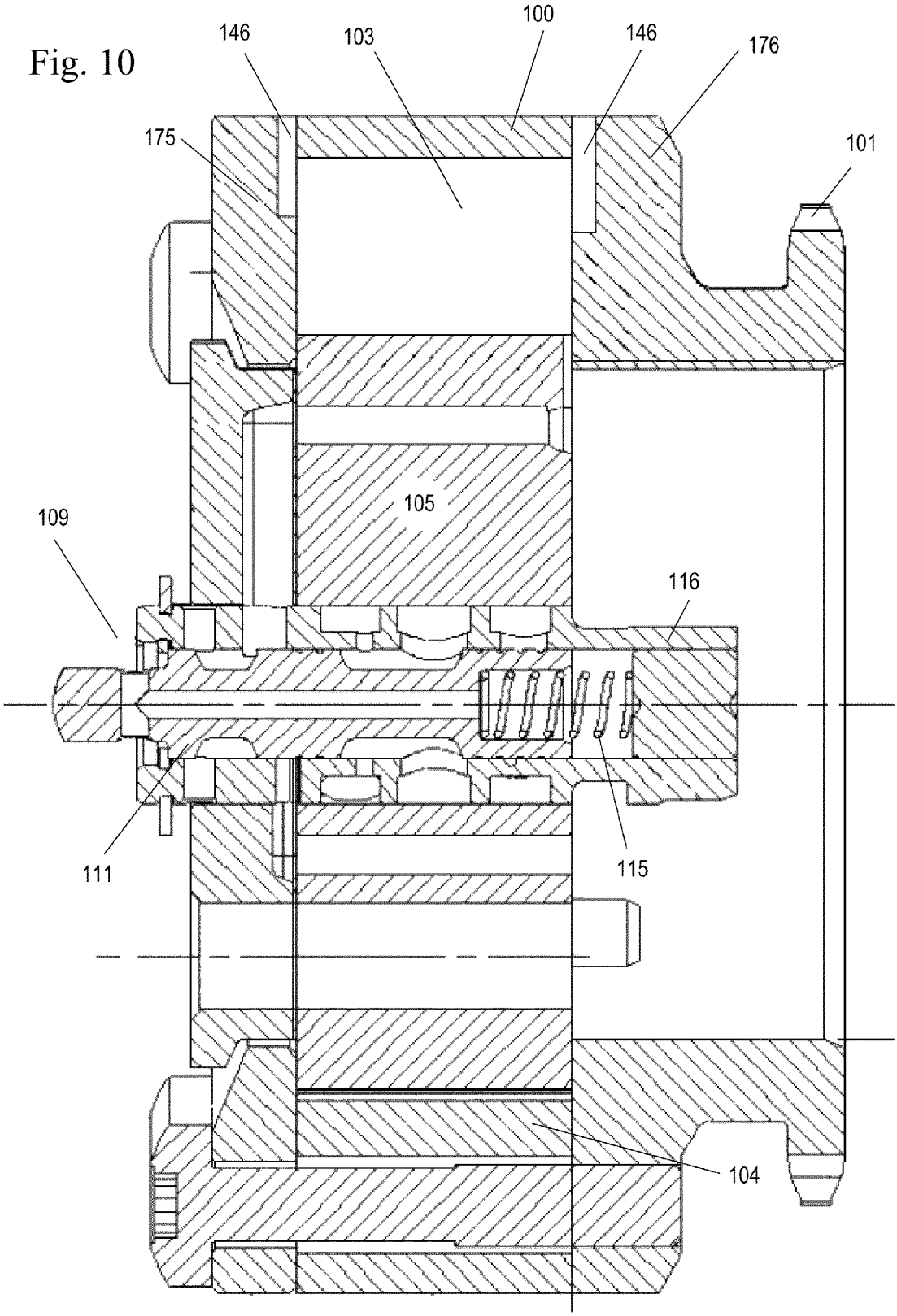
FIG. 10 shows a cross-section along line 19-10 of FIG. 8.

Referring to FIGS. 8-10, vent grooves 146 are present on a second inner end plate 176 and the first outer end plate 175 of the phaser. When phaser is in a retard position as shown in FIG. 8, and the vane 104 is adjacent an advance wall 147 in the chamber defined between the rotor assembly 105 and the housing assembly 100, the vent groove 146 is exposed to fluid in the retard chamber 103. When the phaser is in an advanced position as shown in FIG. 9, and the vane 104 is adjacent the retard wall 148, the vent groove 146 is blocked by the vane 104, preventing any controlled leakage of fluid from the retard chamber 103.

By using the mating components of the rotor assembly 105 and the first outer end plate 175 and the rotor assembly 105 and the second inner end plate 176 as a sort of "on/off" valve, the oscillation of the phaser will not increase due to the leakage from the controlled venting of the controlled leak path through the vent grooves 146 or vent holes 145 when the phaser is off the base stop or not in a base timing position. Furthermore, the system is passive and does require active control from the control valve as described above relative to FIGS. 1-4. The "on/off" valve may also be accomplished, in addition to the examples described above by placing a vent groove or vent hole on a sealing face of one of the end plates near an edge of the rotor assembly, such as the lock pin vane, when the rotor assembly is at base position or base timing. The "on/off" valve could be accomplished in the radial direction between mating components if the fit is tight enough to act as a seal. Using the mating sealing faces of the components as an "on/off" valve eliminates the need for additional components and keeps cost low.

Any of the above described embodiments may also include a flow path for the warmer source oil that increases the surface area exposed as the oil is flowing through the phaser. An example of this would be to require the oil to flow through a vent groove on the face of the rotor assembly 105 or cam end while it is being vented. This would increase the surface area and increase the volume of warm oil in the VCT phaser, increasing the warming rate of the oil in the phaser.

If only one chamber 102, 103 of the VCT phaser contains a vent groove 146 or vent hole 145, the vented chamber 102, 103 is selected so the oil is required to flow around the annulus groove in the sleeve of the control valve to reach the vented chamber. This would increase the contact area exposed to the warmer oil improving the warming rate of the VCT phaser.

Figure 12:
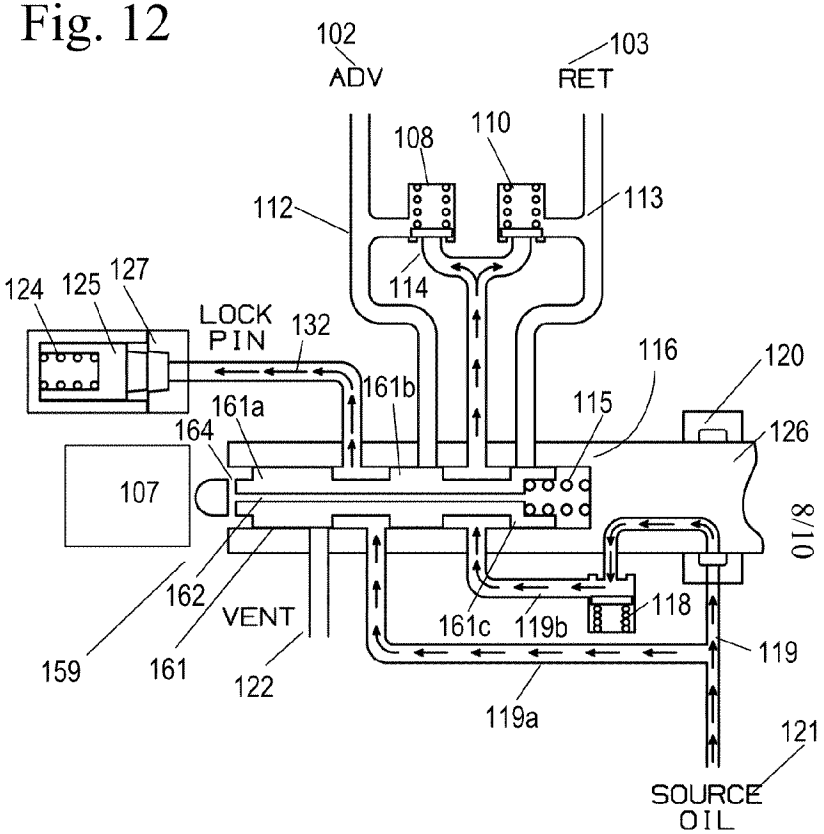
FIG. 12 shows a schematic of a variable cam timing phaser of a fourth embodiment in a null position in which fluid is prevented from venting through the spool and a lock pin is unlocked.
Figure 11:
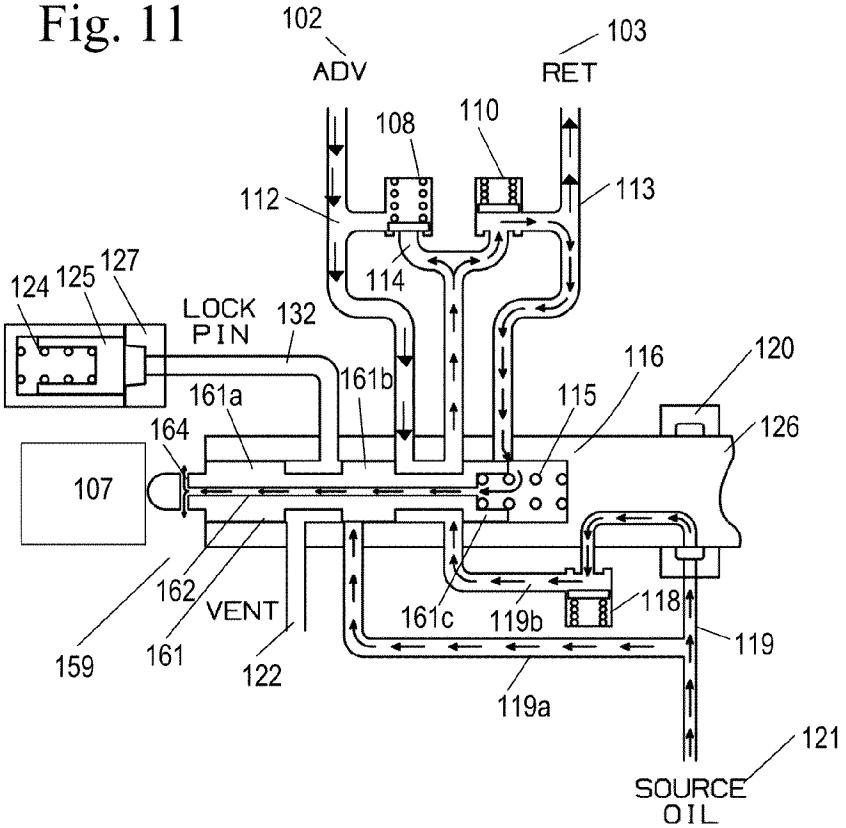
FIG. 11 shows a schematic of a variable cam timing phaser of a fourth embodiment moving towards a retard position in which fluid vents through the spool and a lock pin is locked.
Figure 13:
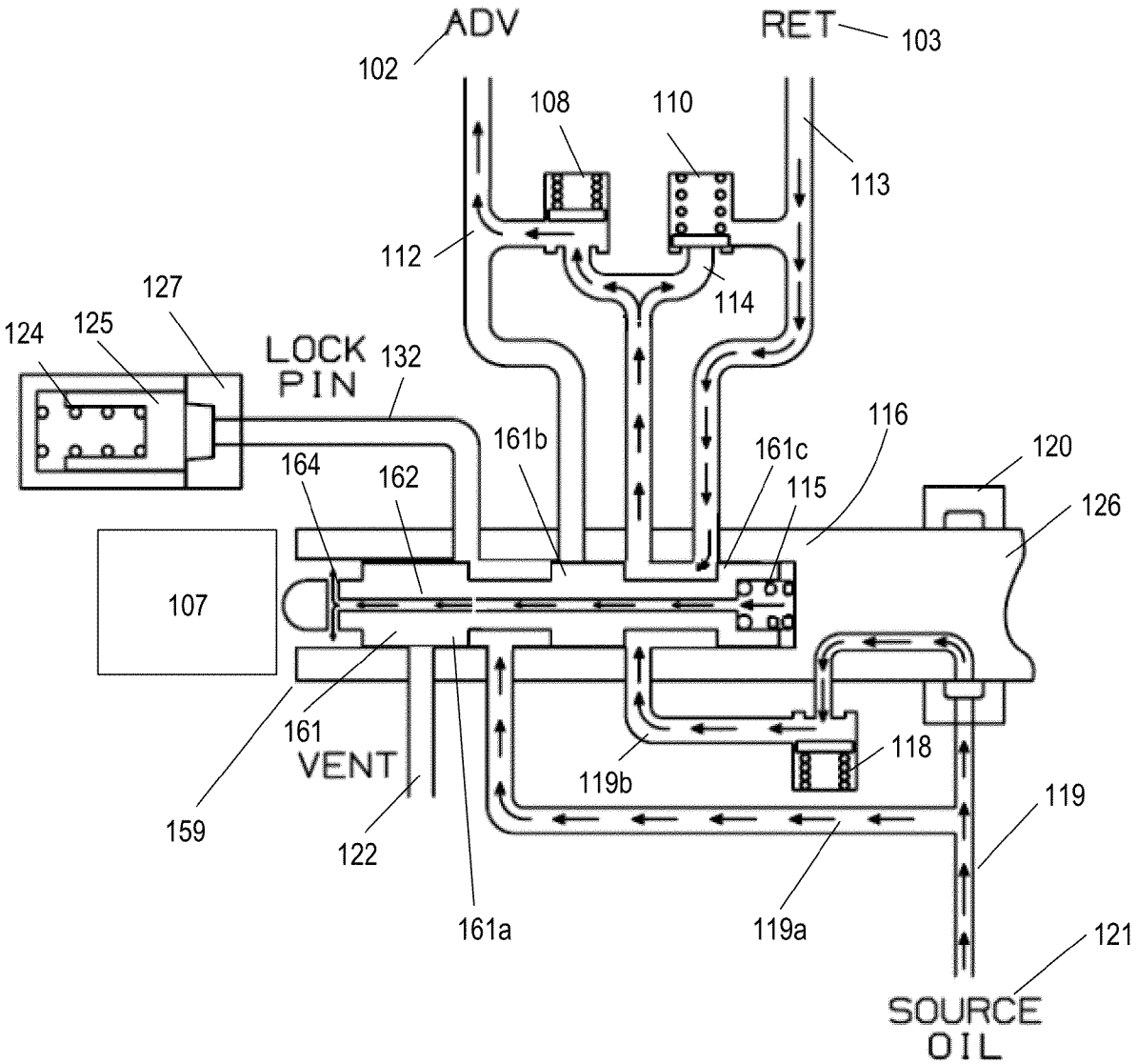
FIG. 13 shows a schematic of a variable cam timing phaser of a fourth embodiment moving towards an advance position in which fluid is prevented from venting through the spool and the lock pin is unlocked.

FIG. 11 through 13 show schematics of a variable cam timing phaser of a fourth embodiment. In this embodiment, the control valve 159 of the VCT phaser or mechanism has been shortened such that at a spool out position or at base timing of the phaser, the porting 112 or 113 leading to the chambers 102, 103 is exposed to the back of the control valve 159 which is vented to atmosphere or sump.

Figure 14:
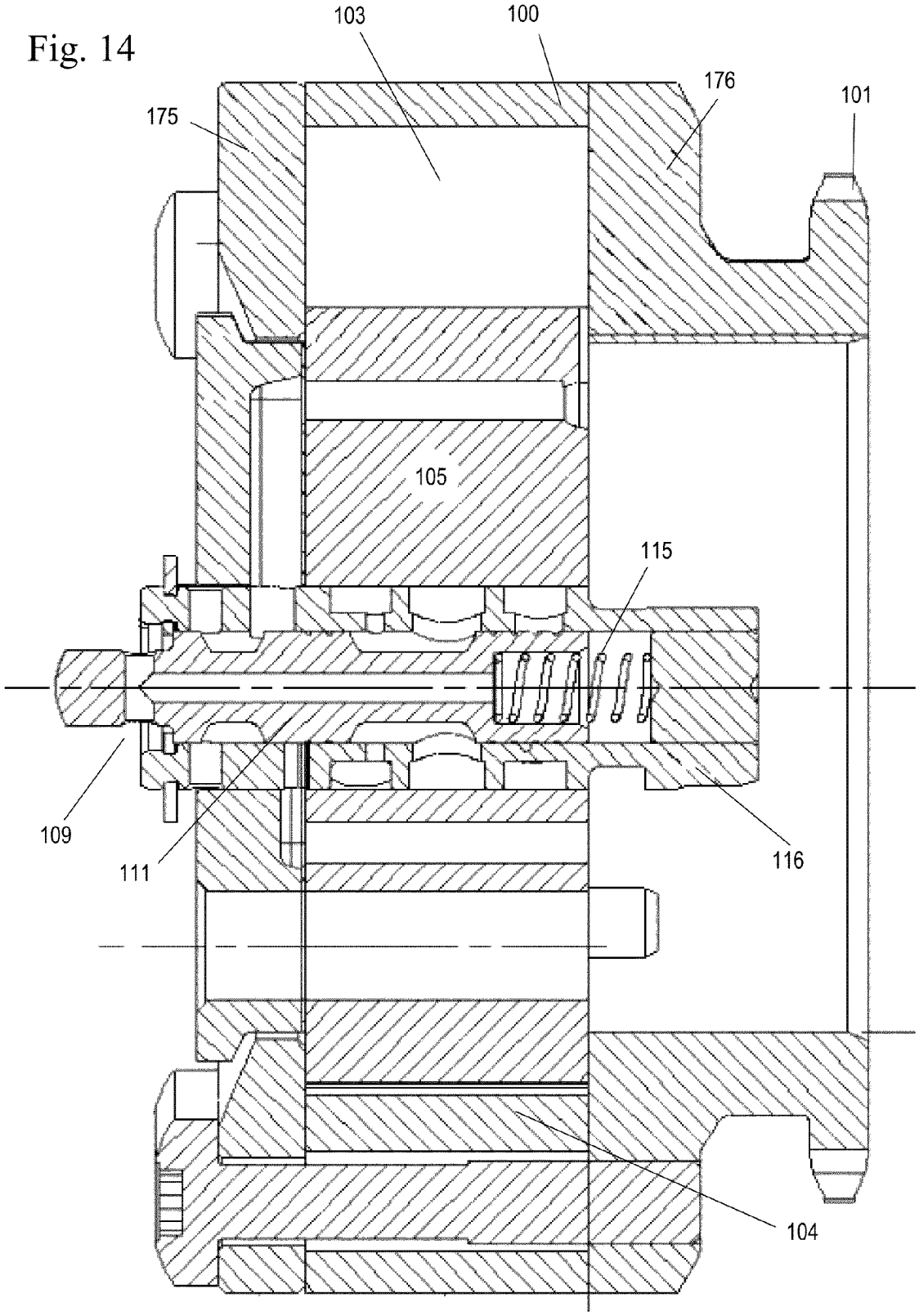
FIG. 14 shows a cross-section of a variable cam timing phaser of a first embodiment.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor assembly 105 with one or more vanes 104, mounted to the end of the camshaft 126, surrounded by a housing assembly 100 with the vane chambers into which the vanes fit. It is possible to have the vanes 104 mounted to the housing assembly 100, and the chambers in the rotor assembly 105, as well. The housing assembly 100 may have a circumference 101 that forms the sprocket, pulley or gear accepting drive force through a chain, belt, or gears, usually from the crankshaft, or possible from another camshaft in a multiple-cam engine. Alternatively, a circumference that forms the sprocket, pulley or gear accepting drive force through a chain, belt, or gears, usually from the crankshaft, or possible from another camshaft in a multiple-cam engine may be present on an end plate of the phaser as shown in FIG. 14.

Torque reversals in the camshaft caused by the forces of opening and closing engine valves move the vane 104. The advance and retard chambers 102, 103 are arranged to resist positive and negative torque pulses in the camshaft 126 and are alternatively pressurized by the cam torque. The control valve 159 allows the vane 104 in the phaser to move by permitting fluid flow from the advance chamber 102 to the retard chamber 103 or vice versa, depending on the desired direction of movement.

The rotor assembly 105 is connected to the camshaft 126 and is coaxially located within the housing assembly 100. The rotor assembly 105 has at least one vane 104 separating a chamber formed between the housing assembly 100 and the rotor assembly 105 into an advance chamber 102 and a retard chamber 103. The vanes 104 are capable of rotation to shift the relative angular position of the housing assembly 100 and the rotor assembly 105.

A lock pin 125 is slidably housed in a bore in the rotor assembly 105 and has an end portion that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The pressurization of line 132 leading to the lock pin 125 is controlled by the switching/movement of the phase control valve 159.

A control valve 159, preferably a spool valve, includes a spool 161 with cylindrical lands 161*a*, 161*b*, and 161*c* slidably received in a sleeve 116 within a bore in the rotor assembly 105 and pilots in the camshaft 126. The spool 161 has an axial spool vent passage 162 that runs from the first land 161*a* through to the third land 161*c* and is in fluid communication radial spool vent passage 164 in the first land 161*a* of the spool 161 to vent any fluid to atmosphere or sump. One end of the spool contacts spring 115 and the opposite end of the spool contacts a control means 107. The control means may be a pulse width modulated variable force solenoid (VFS) 107, a motor, other actuators, or a solenoid that is linearly controlled by varying current or voltage or other methods as applicable.

The position of the spool 161 is influenced by spring 115 and the control means 107 controlled by an ECU (not shown). Further detail regarding control of the phaser is discussed in detail below. The position of the spool 161 controls the motion (e.g. to move towards the advance position, holding position, or the retard position) of the phaser, whether the lock pin 125 is locked or unlocked, and whether fluid source oil may flow continuously through the variable cam timing phaser to vent or sump 122 to bring warm oil from the engine sump to the VCT phaser sooner during the engine warm-up cycle.

In this embodiment, the control valve 159 of the VCT phaser or mechanism has been shortened such that at the spool out position or at base timing of the phaser, the porting leading to the advance or retard chambers 102, 103 is exposed to the back of the spool 161 which is vented to atmosphere or sump through spool vent passages 162, 164. In this position, as shown in FIG. 11, fluid from source 121 enters the common passage 114 and flows through the retard passage 113 within the VCT phaser to the back of the control valve 159 and out the spool vent passages 162, 164. It should be noted that a small amount of fluid that is present between the sleeve 116 and the spool 161 when the phase is moving towards the advance position as shown in FIG. 13 would also vent. This venting of fluid would not be continuous since there is not a direct feed between the retard chamber 103 and the back of the spool 161.

When the spool 161 moves in, the retard passage 113 is blocked and the venting flow of fluid from the spool venting passages 162, 164 is substantially reduced. By having increased flow at the spool out position or at base timing, allows hot oil to fill the VCT phaser sooner. The closed vent during operation of the VCT phaser or phaser minimizes oil usage when the VCT phaser is in operation and oil is hot.

It should be noted that the phase control valve 159 is an active control system for allowing for continuous venting from the retard chamber 103 to sump 122 when the spool 161 is in a base timing position or default position in which the spool 161 is biased out from the sleeve 116 completely by the spring 115 only without any influence from the actuator 107. The base timing position is also the position of the spool 161 in which engine warm-up occurs. While the continuous venting is shown from the retard chamber 103, continuous venting may also occur through the advance chamber 102 as well.

In the advance mode, as shown in FIG. 13, the spool 161 is moved to a position so that fluid may flow from the retard chamber 103 through the spool 161 to the advance chamber 102, and fluid is blocked from exiting the advance chamber 102. Fluid from source 121 may unlock the lock pin 125 by pressurizing line 132, and venting of fluid from source 121 and the retard chamber 103 through the retard passage 113 through the back of the spool 161 is prevented. It should be noted that a small amount of fluid that is present between the sleeve 116 and the spool 161 when the phase is moving towards the advance position would also vent. This venting of fluid would not be continuous since there is not a direct feed between the retard chamber 103 and the back of the spool 161.

In a retard mode as shown in FIG. 11, the spool 161 is moved to a position so that fluid may flow from the advance chamber 102 through the spool 161 to the retard chamber 103, fluid may vent from the retard chamber 103 to the retard passage 113 and through the back of the spool 161 to atmosphere or sump. Fluid from source supplies a constant fluid pressure to maintain fluid to the retard chamber 103 and to spool vent passages 162, 164. The lock pin 125 is locked.

In null mode as shown in FIG. 12, the spool 161 is moved to a position that blocks the exit of fluid from the advance and retard chambers 102, 103, and venting of the retard chamber 103 through the back of the spool 161 through spool vent passages 162, 164 is not permitted. Makeup oil may be supplied to the advance and retard chambers 102, 103 as needed. Fluid from source 121 unlocks the lock pin 125 by pressurizing line 132.

FIG. 11 shows the phaser moving towards the retard position. To move towards the retard position, the force of the control means 107 on the spool 161 is changed, such that the spool 161 is moved to the left in a retard mode in the figure by spring 115, until the force of spring 115 balances the force of the control means 107. In the retard mode shown, spool land 161*c* slightly blocks line 113 and lines 112 and 114 are open. Spool land 161*c* is in a position such that fluid from the retard passage 113 may flow to the back of the spool 161 to the spool vent passages 162, 164 to atmosphere or sump. Source oil from supply 121 provides a continuous supply of fluid to the retard chamber 103 and therefore to vent to atmosphere or sump through the retard passage 113 and the spool vent passages 162, 164. Camshaft torque pressurizes the advance chamber 102, causing fluid in the advance chamber 102 to move into the retard chamber 103, and the vane 104 to move accordingly. Fluid exits from the advance chamber 102 through line 112 to the control valve 159 between spool lands 161*b* and 161*c* and recirculates back to central or common line 114 and line 113 leading to the retard chamber 103.

Makeup oil to make up for any leakage and oil to supply continuous venting of fluid to warm up the phaser is supplied to the phaser from supply S 121 and enters line 119 through a bearing 120. Line 119 splits into two lines 119*a* and 119*b*. Line 119*b* leads to an inlet check valve 118 and the control valve 159. From the control valve 159, fluid enters line 114 and then passes through either of the check valves 108, 110, depending on which is open to the chambers 102, 103. Line 119*a* leads to control valve 159 and is blocked by land 161*b* from pressurizing line 132 and from biasing the lock pin 125 to an unlocked position, and therefore, the lock pin 125 remains in a locked position, engaged with recess 127. Exhaust line 122 is blocked from receiving fluid from line 119*a* by spool land 161*b*.

FIG. 13 shows the phaser moving towards the advance position. To move towards the advance position, the force of the control means 107 on the spool 161 is increased and the spool 161 is moved to the right by the control means 107 in an advance mode, until the force of the spring 115 balances the force of the control means 107. In the advance mode shown, spool land 161*b* blocks line 112 and lines 113 and 114 are open. Camshaft torque pressurizes the retard chamber 103, causing fluid to move from the retard chamber 103 and into the advance chamber 102, and the vane 104 moves accordingly. Fluid exits from the retard chamber 103 through line 113 to the control valve 159 between spool lands 161*b* and 161*c* and recirculates back to central line 114 and line 112 leading to the advance chamber 102.

Makeup oil is supplied to the phaser from supply S 121 to make up for leakage and enters line 119 through a bearing 120. Line 119 splits into two lines 119*a* and 119*b*. Line 119*b* leads to an inlet check valve 118 and the control valve 159. From the control valve 159, fluid enters line 114 and then passes through either of the check valves 108, 110, depending on which is open to the chambers 102, 103. Line 119*a* leads to control valve 159 and is open to line 132 leading to the lock pin 125 The pressure of the fluid in line 119*a* moves through the spool 161 between lands 161*a* and 161*b* to pressurize line 132 and bias the lock pin 125 against the spring 124 to a released position. Exhaust line 122 is blocked by spool land 161*a*, preventing the lock pin 125 from venting.

When the phaser in the holding position as shown in FIG. 12, the force of the control means 107 on one end of the spool 161 equals the force of the spring 115 on the opposite end of the spool 161 in holding mode. The lands 161*b* and 161*c* block the flow of fluid to lines 112 and 113 respectively. Makeup oil is supplied to the phaser from supply S by to make up for leakage and enters line 119 through a bearing 120. Line 119 splits into two lines 119*a* and 119*b*. Line 119*b* leads to inlet check valve 118 and the control valve 159. From the control valve 159, fluid enters line 114 and then passes through either of the check valves 108, 110, depending on which is open to the chambers 102, 103. Fluid from source 121 unlocks the lock pin 125 by pressurizing line 132.

The lock pin 125 may be used without using a control means 107 (i.e. use it as a passive system) by increasing venting that occurs at the default spool valve position or at a base timing of the phaser that occurs in the VCT phaser when the control system is turned off. Base timing or default position of the spool is when the spool 161 is biased out from the sleeve 116 completely by the spring 115 only without any influence from the actuator 107. The base timing position is also the position of the spool 161 in which engine warm-up occurs.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine including a housing assembly coupled to a first outer end plate and a second inner end plate with an outer circumference for accepting drive force and a rotor assembly for connection to a camshaft, coaxially located within the housing assembly having a plurality of vanes, wherein the housing assembly and the rotor assembly define at least one chamber separated by a vane into an advance chamber and a retard chamber, the vane within the chamber acting to shift relative angular position of the housing assembly and the rotor assembly, comprising:

a control valve for directing fluid to and from a sump through a vent passage, and to and from the chambers through an advance line, a retard line, and a common line, the control valve being movable in a first bore towards an advance mode, a holding position, a retard mode, and a vent mode;

wherein when the control valve is moved to the vent mode, fluid from a source is in continuous fluid communication through the control valve with the vent passage in fluid communication with the sump and fluid in the advance chamber and the retard chamber is blocked from venting to the sump through the control valve.

2. The phaser of claim 1, further comprising a lock pin located in the rotor assembly or the housing assembly, the lock pin being moveable in a second bore from a locked position in which an end portion engages a recess, locking the relative angular position of the housing assembly and the rotor assembly, to an unlocked position, in which the end portion does not engage the recess.

3. The phaser of claim 2, wherein the control valve further directs fluid to and from a recess of the lock pin through a lock pin passage.

4. The phaser of claim 2, wherein when the control valve is the vent mode, fluid from the source is in fluid communication with the lock pin passage leading to the recess in which the lock pin can engage when in a locked position.

5. The phaser of claim 1, wherein when the control valve is moved towards the advance mode or in the holding position, the control valve blocks the flow of fluid to the vent passage in fluid communication with the sump and the lock pin moves to the unlocked position.

6. The phaser of claim 1, wherein when the control valve is moved towards the retard mode, the control valve blocks the flow of fluid from the source of fluid to the lock pin passage and the vent passage in fluid communication with the sump and the lock pin is moved to a locked position.

7. The phaser of claim 1, wherein when the control valve is moved towards the advance mode, the control valve blocks the flow of fluid from a source of fluid to the lock pin passage and the vent passage in fluid communication with the sump and the lock pin is moved to a locked position.

8. The phaser of claim 1, wherein when the control valve is moved towards the retard mode or in the holding position, the control valve blocks the flow of fluid to the vent passage in fluid communication with the sump and the lock pin moves to the unlocked position.

9. The phaser of claim 1, wherein the common line further comprises check valves.

10. The phaser of claim 1, wherein the when the control valve is moved to the vent mode, the phaser is at base timing.

11. A variable cam timing phaser for an internal combustion engine including a housing assembly coupled to a first outer end plate and a second inner end plate with an outer circumference for accepting drive force and a rotor assembly for connection to a camshaft, coaxially located within the housing assembly having a plurality of vanes, wherein the housing assembly and the rotor assembly define at least one chamber separated by a vane into an advance chamber and a retard chamber, the vane within the chamber acting to shift relative angular position of the housing assembly and the rotor assembly, comprising:

a control valve for directing fluid to and from the chambers through an advance line, a retard line, and a common line, the control valve comprising a spool slidably received within a first bore including a plurality of lands and at least one vent passage in communication with a sump;

wherein the control valve is movable to a position in which the retard line or the advance line is in fluid communication with at least one of the vent passages in the spool and in which fluid vents continuously from a source to the sump.

12. The phaser of claim 11, further comprising a lock pin located in the rotor assembly or the housing assembly, the lock pin being moveable in a second bore from a locked position in which an end portion engages a recess, locking the relative angular position of the housing assembly and the rotor assembly, to an unlocked position, in which the end portion does not engage the recess.

13. The phaser of claim 11, wherein at least one of the vent passage in the control valve comprises an axial vent passage and a radial vent passage each leading to the sump.

14. The phaser of claim 11, further comprising wherein the common line further comprises check valves.

15. A variable cam timing phaser for an internal combustion engine including a housing assembly coupled to a first outer end plate and a second inner end plate with an outer circumference for accepting drive force and a rotor assembly for connection to a camshaft, coaxially located within the housing assembly having a plurality of vanes, wherein the housing assembly and the rotor assembly define at least one chamber separated by a vane into an advance chamber and a retard chamber, the vane within the chamber acting to shift relative angular position of the housing assembly and the rotor assembly, comprising:

a venting mechanism located on at least one of the first outer end plate and the second inner end plate for continuously venting fluid from the advance chamber or the retard chamber to a sump comprising a temperature compensating valve;

wherein when the vane is a first position, fluid from the advance chamber or the retard chamber is blocked by the vane from venting through the venting mechanism to the sump;

wherein when the vane is in a second position, fluid from the advance chamber or the retard chamber is vented to sump through the venting mechanism.

16. The phaser of claim 15, wherein the venting mechanism is at least one hole in the advance chamber or the retard chamber.

17. The phaser of claim 15, wherein the venting mechanism is at least one groove in the advance chamber or the retard chamber.

18. The phaser of claim 15, wherein the venting mechanism further comprises a pressure relief valve.

19. The phaser of claim 15, wherein the venting mechanism further comprises a one way check valve.

* * * * *